US006283563B1

(12) United States Patent
Lambright et al.

(10) Patent No.: US 6,283,563 B1
(45) Date of Patent: Sep. 4, 2001

(54) FURNITURE UNIT

(75) Inventors: Michael D. Lambright, Archbold; Troy E. Tedrow, Wauseon, both of OH (US)

(73) Assignee: Sauder Woodworking Co., Archbold, OH (US)

( * ) Notice: Subject to any disclaimer, the term of this patent is extended or adjusted under 35 U.S.C. 154(b) by 0 days.

(21) Appl. No.: 09/505,740

(22) Filed: Feb. 16, 2000

(51) Int. Cl.[7] ..... A47B 45/00

(52) U.S. Cl. ..... 312/205; 312/203

(58) Field of Search ..... 312/203, 205

(56) References Cited

U.S. PATENT DOCUMENTS 5,795,041 * 8/1998 Weaver ..... 312/205

* cited by examiner

*Primary Examiner*—Peter M. Cuomo
*Assistant Examiner*—Michael J Fisher
(74) *Attorney, Agent, or Firm*—Emch, Schaffer, Schaub & Porcello Co., L.P.A.

(57) ABSTRACT

A furniture unit having a first tower and a second tower spaced from the first tower. Each of the first and second towers includes a first attachment surface and a second attachment surface. The furniture unit further includes an undivided top bridge member and an undivided bottom bridge member spaced from the top bridge member. The top bridge member has opposed ends each being attached to the first attachment surfaces. The bottom bridge member has opposed ends being attached to the second attachment surfaces. The first and second towers define a space for receiving a television or a television stand for supporting a television.

10 Claims, 7 Drawing Sheets

FURNITURE UNIT

BACKGROUND OF THE INVENTION

The present invention relates generally to a furniture unit. More specifically, the invention is directed to a furniture assembly that can be adjusted to accommodate, for example, various sizes of large screen televisions. These types of furniture units are commonly referred to as "home theaters" or "entertainment centers".

Home theater furniture units are known in the art. For example, cabinet. This prior art cabinet includes, among other things, a pair of segmented bridge members.

It has been found that there is a need for a furniture unit that includes, among other things, a pair of continuous, unitary and undivided bridge members that can be easily used and adjusted. The present invention satisfies this need.

SUMMARY OF THE INVENTION

The present invention is directed to a furniture unit having a first tower and a second tower spaced from the first tower. Each of the towers includes a first attachment surface and a second attachment surface.

The furniture unit further includes an undivided top bridge member and an undivided bottom bridge member spaced from the top bridge member. The top bridge member has opposed ends each being attached to the first attachment surfaces. The bottom bridge member has opposed ends being attached to the second attachment surfaces.

It is a primary object of the present invention to provide a furniture unit that includes continuous, unitary and undivided bridge members that are easy to use and adjust.

Other objects and advantages of the present invention will become apparent to those skilled in the art upon a review of the following detailed description of the preferred embodiment and the accompanying drawings.

DETAILED DESCRIPTION OF THE PREFERRED EMBODIMENT

Figure 1:
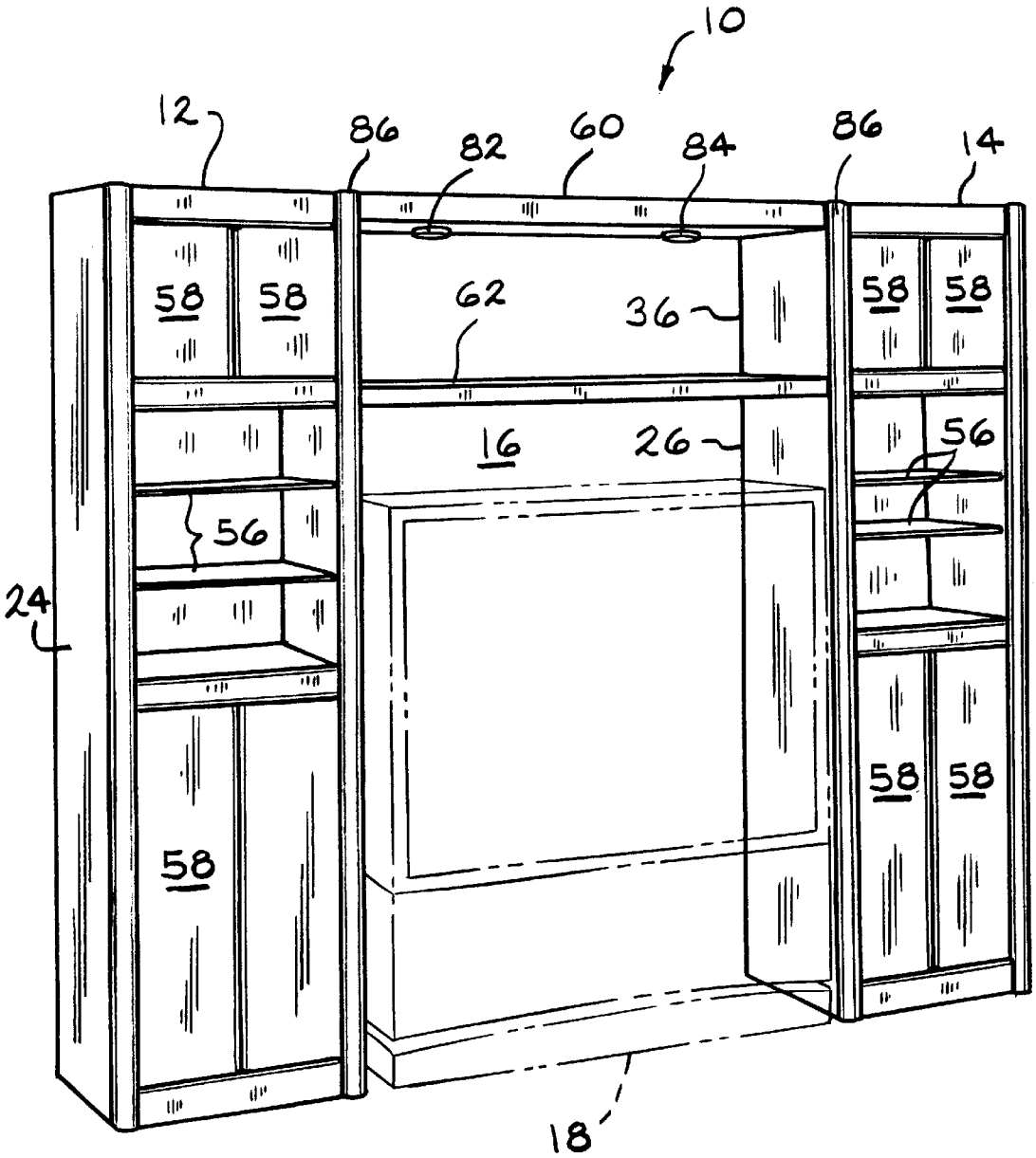
FIG. 1 is a front perspective view of a furniture unit according to the present invention with a large screen television shown in broken broken lines.

The preferred embodiment and best mode of the present invention will now be described in detail with reference being made to the drawings. In the drawings, the furniture unit of the present invention is indicated generally by the reference number "10".

Figure 2:
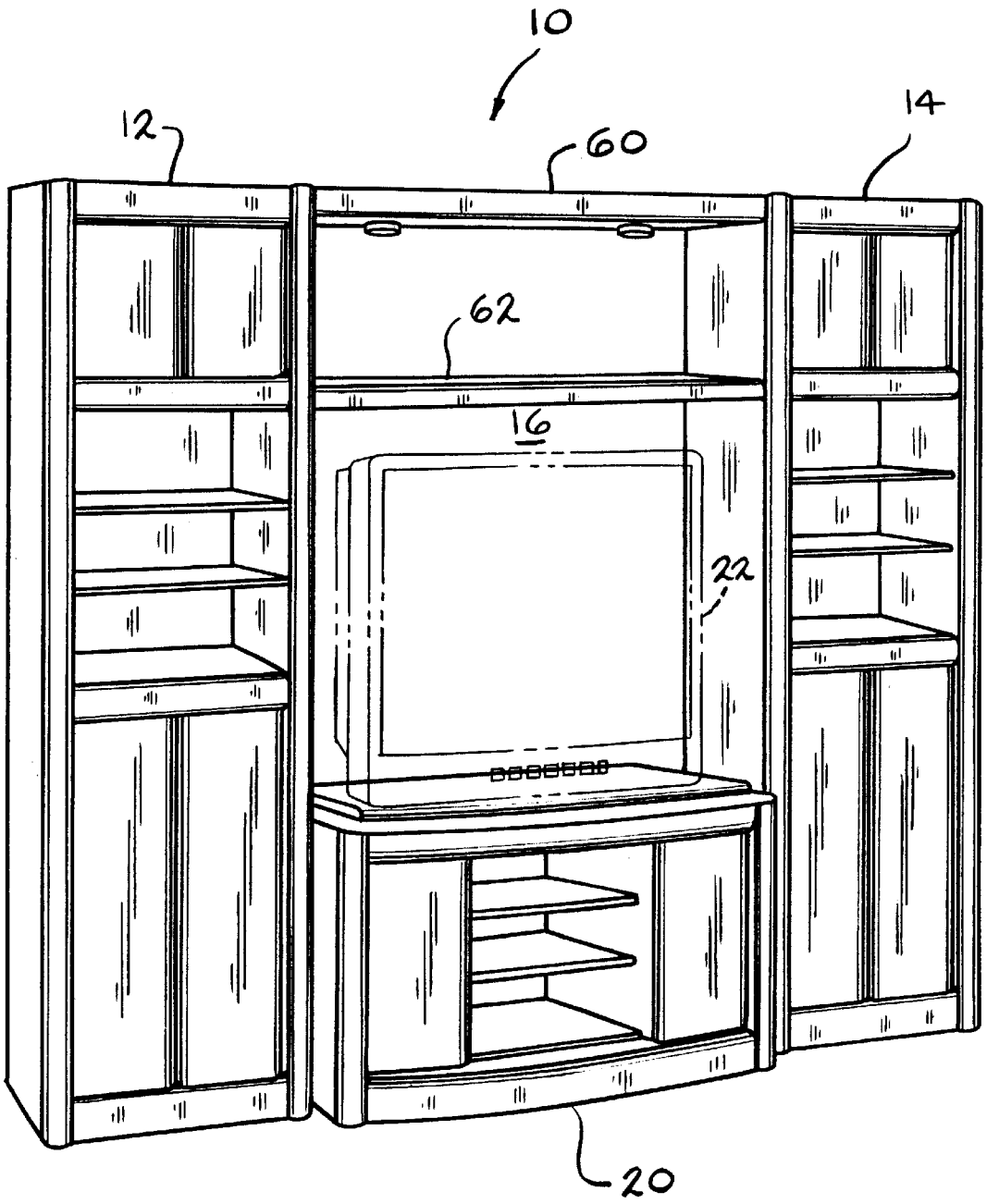
FIG. 2 is a view similar to the view of FIG. 1 with a television stand positioned adjacent to the furniture unit with a television shown in broken lines.

Referring to FIGS. 1–5, the furniture unit 10 includes a first tower 12 and a second tower 14 spaced from the first tower 12. As shown in FIGS. 1 and 2, the first and second towers 12 and 14 define a space 16 for receiving either a large screen television 18 (FIG. 1) or a television stand 20 for supporting a television 22 (FIG. 2). As described below, the furniture unit 10 can be adjusted to vary the size of the space 16 to accommodate a variety of televisions and television stands.

Referring again to FIGS. 1–5, each of the first and second towers 12 and 14 includes a first sidewall 24 and a second sidewall 26 spaced from the first sidewall 24. As shown in FIG. 4, the first sidewall extends vertically from a base 28 to a top 30. The second sidewall 26 extend vertically from a base 32 to a top 34. The top 34 is positioned at a midpoint with respect to the base 28 and top 30 of the first sidewall 24. Each of the first and second towers 12 and 14 includes an upper sidewall 36 that is vertically extending from a lower portion 38 and an upper portion 40. As shown in FIGS. 4 and 5, the tops 34 of the second sidewalls 26 are spaced from the lower portions 38 of the upper sidewalls 36 to define spaces 42.

Figure 3:
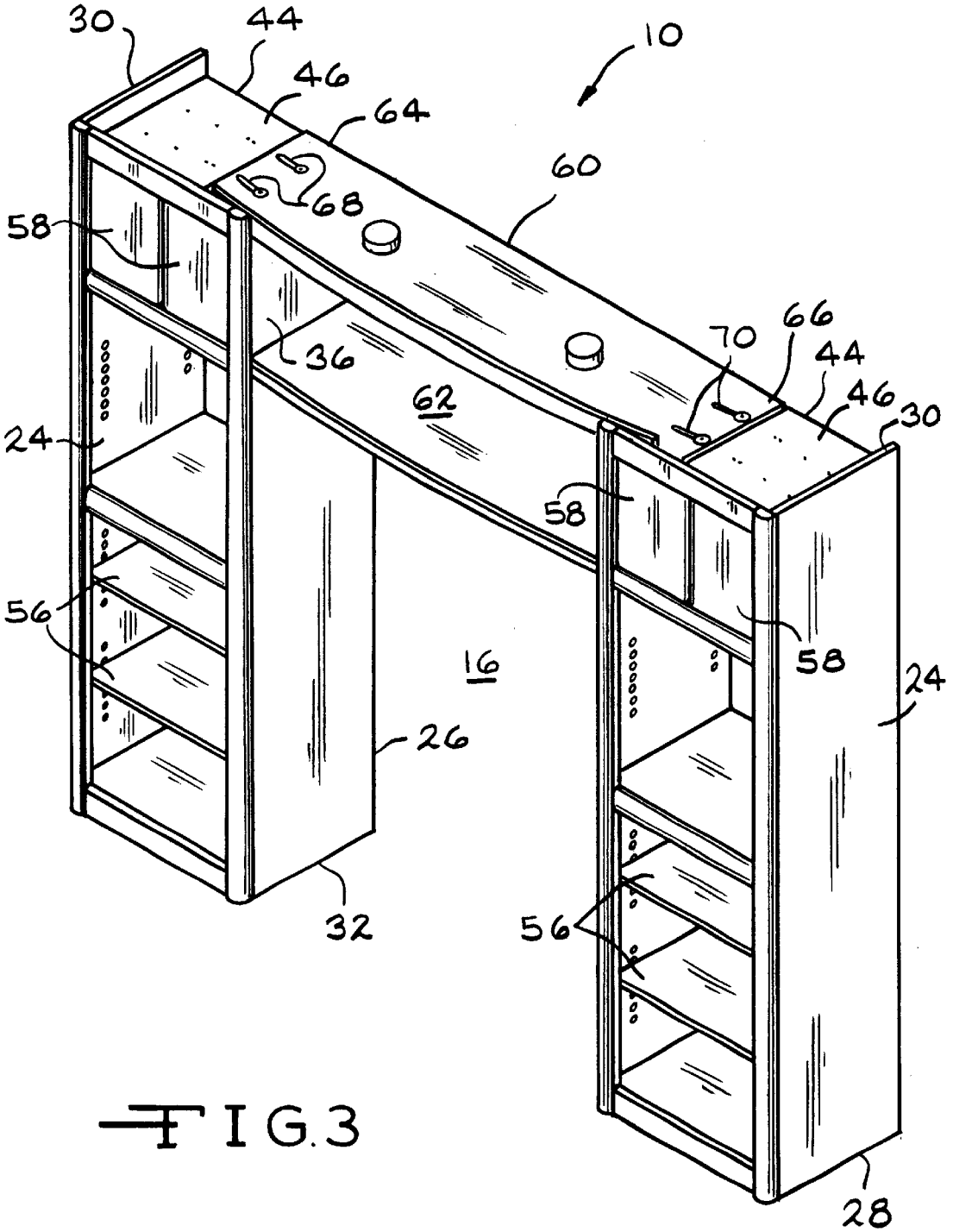
FIG. 3 is a top front perspective view of the furniture unit.
Figure 4:
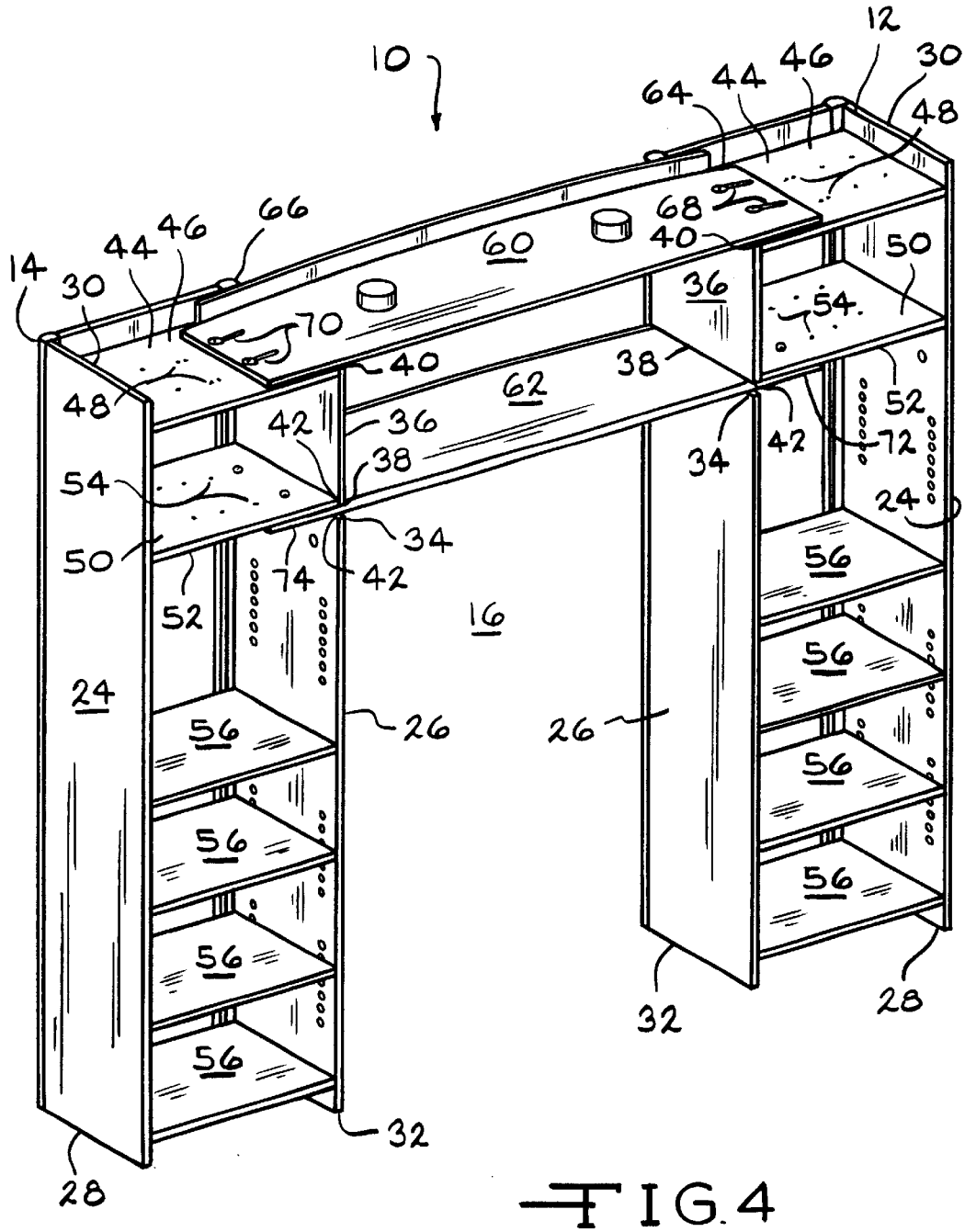
FIG. 4 is a back top perspective view of the furniture unit.
Figure 5:
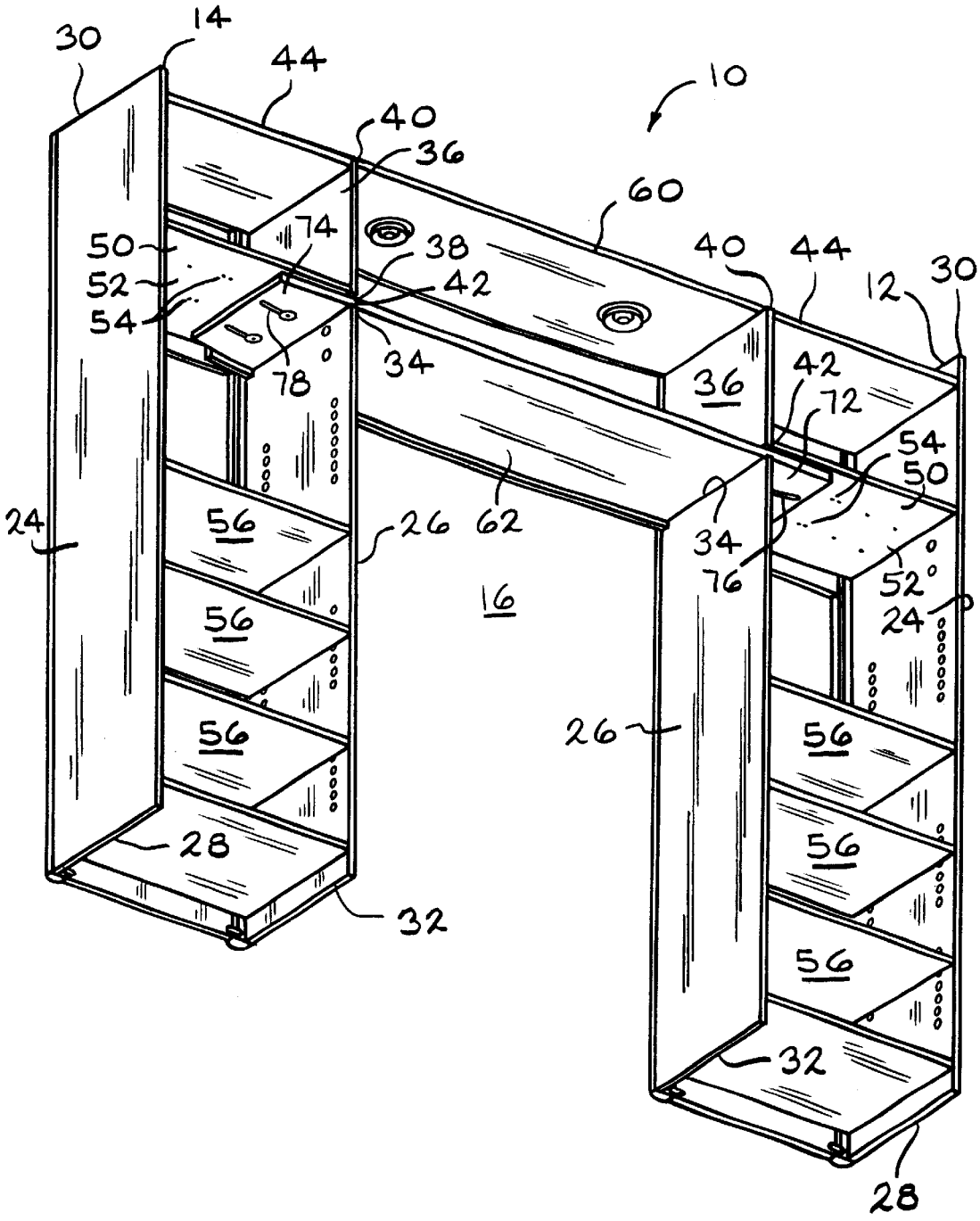
FIG. 5 is a back bottom perspective view of the furniture unit.

Referring to FIGS. 3–5, each of the first and second towers 12 and 14 includes a top member 44 that is horizontally extending between the first sidewall 24 and the upper sidewall 36. The top member 44 includes a horizontally extending first attachment surface 46. The first attachment surface 46 includes a plurality of spaced openings 48 that are arranged in a predetermined pattern.

Still referring to FIGS. 3–5, each of the first and second towers 12 and 14 includes a bottom member 50 that is horizontally extending between the first sidewall 24 and the upper sidewall 36. The bottom member 50 includes a horizontally extending second attachment surface 52. The second attachment surface 52 includes a plurality of openings 54 that are arranged in a predetermined pattern. As shown in FIGS. 3–5, the top member 44 is spaced from the bottom member 50. Accordingly, the first and second attachment surfaces 46 and 52 are spaced from one another.

Referring to FIGS. 1–5, each of the first and second towers 12 and 14 includes a plurality of shelves 56. The bottom members 50 can also be used as shelves. The first and second towers 12 and 14 also include movable doors 58 (FIG. 1).

Referring now to FIGS. 4–9, the furniture unit 10 includes a continuous, unitary and undivided top bridge member 60 and a continuous, unitary and undivided bottom bridge member 62 spaced from the top bridge member 60. The top and bottom bridge members 60 and 62 are horizontally extending between the first and second towers 12 and 14 to span the space 16 defined by the towers.

Figure 6:
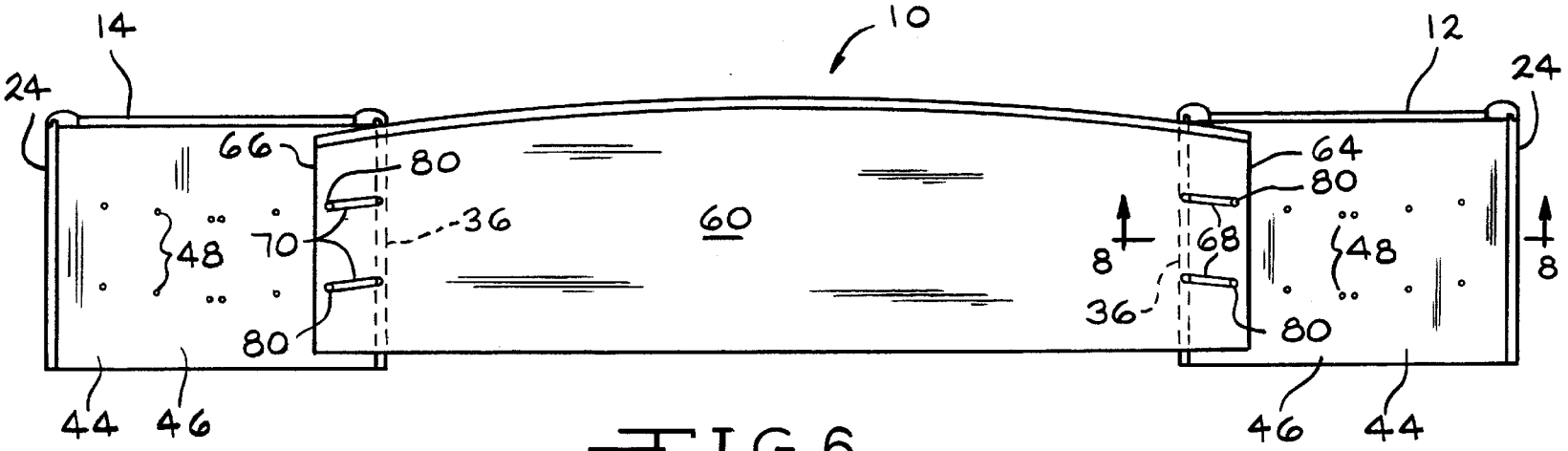
FIG. 6 is a top view of the furniture unit in a first position.
Figure 7:
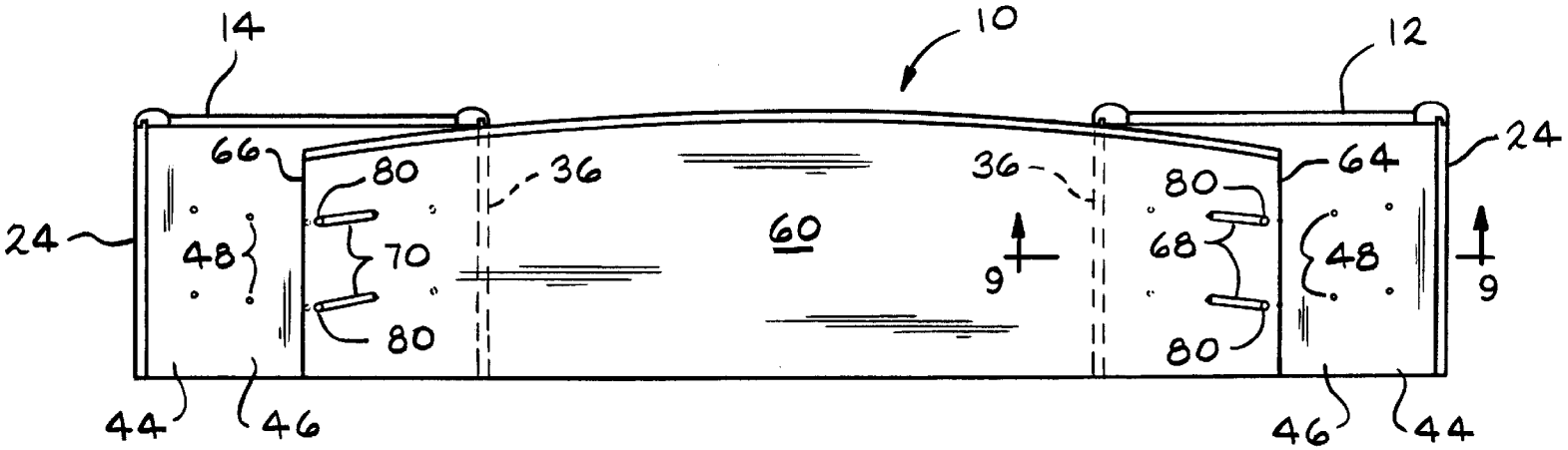
FIG. 7 is a top view of the furniture unit in a second position.
Figure 8:
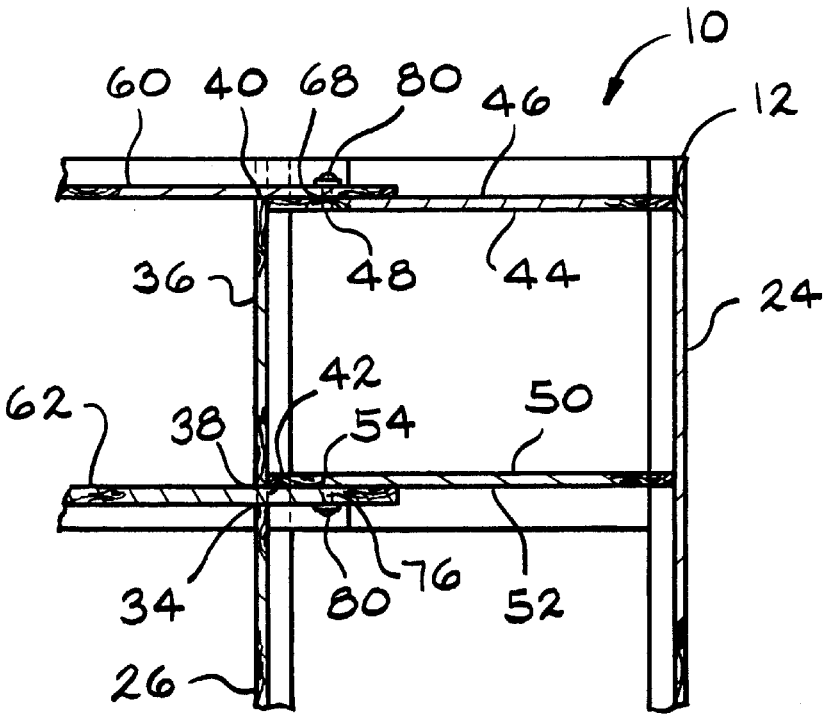
FIG. 8 is a cross-sectional view taken along line 8—8 of FIG. 6.
Figure 9:
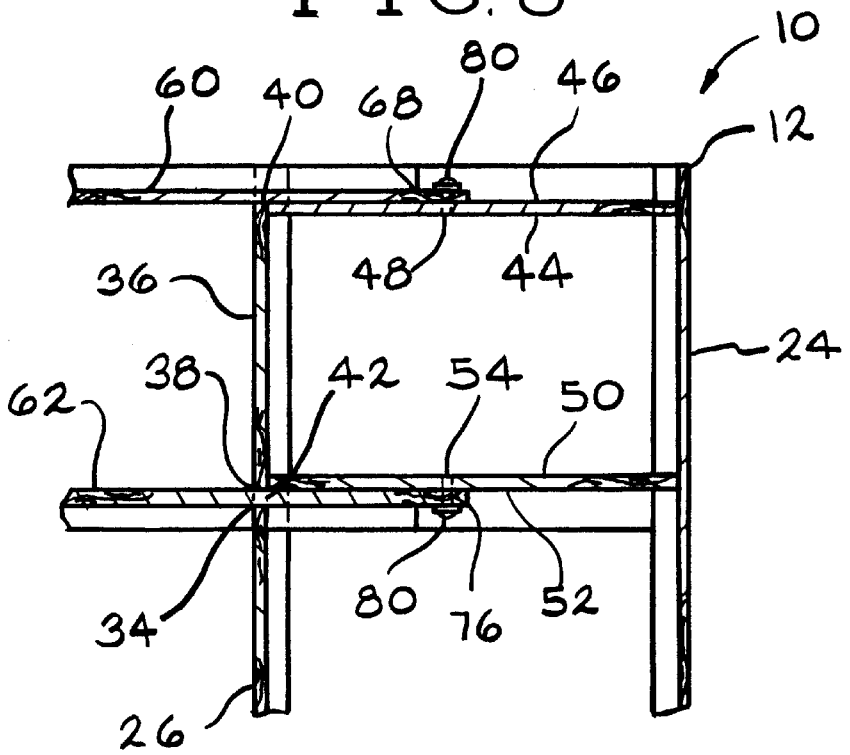
FIG. 9 is a cross-sectional view taken along line 9—9 of FIG. 7.

Still referring to FIGS. 4–9, the top bridge member 60 includes a first end 64 and an opposed second end 66. The first end 64 includes a pair of spaced curved slots 68. The second end 66 includes a pair of spaced curved slots 70. As shown in FIGS. 6 and 7, the slots 68 and 70 correspond to the openings 48 of the first attachment surfaces 46 of the top members 44.

As shown in FIGS. 4–9, the bottom bridge member 62 includes a first end 72 and an opposed second end 74. The first end 72 includes a pair of spaced curved slots 76 and the second end 74 includes a pair of spaced curved slots 78. The slots 76 and 78 correspond to the openings 54 of the second attachment surfaces 52 of the bottom members 50.

As shown in FIGS. 4 and 5, the top bridge member 60 is positioned between the first and second towers 12 and 14 so that the first end 64 is positioned adjacent to the first attachment surface 46 of the first tower 12 and the second end 66 is positioned adjacent to the first attachment surface 46 of the second tower 14. The bottom bridge member 62 is positioned in the spaces 42 so that the first end 72 is positioned adjacent to the second attachment surface 52 of the first tower 12 and the second end 74 is positioned adjacent to the second attachment surface 52 of the second tower 14.

As shown in FIGS. 6–9, the furniture unit 10 can be adjusted to vary the size of the space 16 depending on the size of the large screen television 18 (FIG. 1) or the size of the television stand 20 (FIG. 2). This is accomplished by determining the width of, for example, the large screen television 18 and using this measurement to determine how far the first and second towers 12 and 14 should be spaced from one another. Once the towers have been properly spaced, the top and bottom bridge members 60 and 62 can be adjusted, as described above, so that the slots 68 and 70 of the top bridge member 60 are positioned adjacent to the openings 48 of the first attachment surfaces 46 and the slots 76 and 78 of the bottom bridge member 62 are positioned adjacent to the openings 54 of the second attachment surfaces 52. Fastening devices, such as bolts 80 can then be positioned through the respective slots and openings in order to firmly attach the top and bottom bridge members 60 and 62 to the first and second towers 12 and 14.

As shown in FIG. 1, the top bridge member 60 includes a pair of electric accent lights 82 and 84 for illuminating the bottom bridge member 62. The furniture unit 10 also includes a plurality of trim pieces 86 for decorative purposes.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

What is claimed is:

1. A furniture unit comprising:

a first tower and a second tower spaced from said first tower, each of said first and second towers having a first sidewall and a second sidewall, each of said first and second towers including a top member having a first attachment surface and a bottom member having a second attachment surface, each of said first and second attachment surfaces being positioned between said first and second sidewalls; and a one-piece top bridge member and a one-piece bottom bridge member spaced from said top bridge member, said top bridge member having opposed ends each being attached to said first attachment surfaces, said bottom bridge member having opposed ends being attached to said second attachment surfaces, said top bridge member spanning completely between said top members of said first and second towers, and said bottom bridge member spanning completely between said bottom members of said first and second towers.

2. The furniture unit of claim 1, wherein said first and second towers are generally vertically extending.

3. The furniture unit of claim 2, wherein said top and bottom bridge members are generally horizontally extending.

4. The furniture unit of claim 1, wherein said first and second towers each includes at least one shelf.

5. The furniture unit of claim 1, wherein each of said first attachment surfaces includes at least one opening, each of said opposed ends of said top bridge member having at least one slot corresponding to said at least one opening, fastening means extending through said at least one opening and at least one slot.

6. The furniture unit of claim 1, wherein each of said second attachment surfaces includes at least one opening, each of said opposed ends of said bottom bridge member having at least one slot corresponding to said at least one opening, fastening means extending through said at least one opening and at least one slot.

7. The furniture unit of claim 1, wherein said top bridge member includes lighting means.

8. The furniture unit of claim 7 wherein said lighting means consists of at least one electric light.

9. A furniture unit comprising:

a first tower spaced from a second tower, each of said first and second towers having a first sidewall and a second sidewall, each of said first and second towers including a top member having an integral first attachment surface spaced from a bottom member having an integral second attachment surface, each of said first and second attachment surfaces being positioned between said first and second sidewalls, each of said first attachment surfaces including a first opening, each of said second attachment surfaces including a second opening;

a one-piece top bridge member spanning completely between said top members of said first and second towers including opposed ends each including an elongated first slot corresponding to said first openings of said first attachment surfaces, first fasteners extending through said corresponding first openings and first slots to adjustably attach said top bridge member to said first and second towers; and a one-piece bottom bridge member spanning completely between said bottom members of said first and second towers including opposed portions each including an elongated second slot corresponding to said second openings of said second attachment surfaces, second fasteners extending through said corresponding second openings and second slots to adjustably attach said bottom bridge member to said first and second towers.

10. The furniture unit of claim 9, wherein said top bridge member includes two spaced electric lights.

* * * * *

UNITED STATES PATENT AND TRADEMARK OFFICE

CERTIFICATE OF CORRECTION

PATENT NO. : 6,283,563 B1
DATED : September 4, 2001
INVENTOR(S) : Michael D. Lambright et al.

It is certified that error appears in the above-identified patent and that said Letters Patent is hereby corrected as shown below:

Column 1,
Line 12, in the Background of the Invention, before the first use of the word "cabinet", insert -- U.S. Patent No. 5,303,057 is directed to a universal projection television --.

Signed and Sealed this

Twelfth Day of March, 2002

*Attest:*

*Attesting Officer*

JAMES E. ROGAN
*Director of the United States Patent and Trademark Office*